United States Patent [19]

Jenkins

[11] 4,134,615

[45] Jan. 16, 1979

[54] SEATING SETUP

[76] Inventor: John F. Jenkins, 137 N. Shore Rd., Absecon, N.J. 08201

[21] Appl. No.: 784,654

[22] Filed: Apr. 4, 1977

[51] Int. Cl.[2] ..... A47C 7/72; A47C 25/05

[52] U.S. Cl. ..... 297/180

[58] Field of Search ..... 297/180, 453; 126/204, 126/208; 98/2.03; 237/77; 219/217; 128/24.1, 400, 402

[56] References Cited

U.S. PATENT DOCUMENTS

| | | | |
|---|---|---|---|
| 34,501 | 2/1862 | Hunt | 126/208 |
| 38,271 | 4/1863 | Ackley | 126/208 |
| 525,252 | 8/1894 | Boyd et al. | 126/208 |
| 1,475,912 | 11/1923 | Williams | 297/180 |
| 2,358,071 | 9/1974 | Hurtado | 219/217 X |
| 2,521,091 | 9/1950 | Pophal | 297/180 |
| 2,583,816 | 1/1952 | Butler | 126/204 X |
| 2,851,573 | 9/1958 | Muccilli | 126/204 UX |
| 3,745,305 | 7/1973 | Reed et al. | 219/217 |
| 3,858,643 | 1/1975 | Reed et al. | 27/180 X |
| 3,948,246 | 4/1976 | Jenkins | 126/204 |

*Primary Examiner*—James T. McCall
*Attorney, Agent, or Firm*—Eugene Chovanes; Edward Lovett Jackson

[57] ABSTRACT

This involves a seating setup for people sitting side by side in a relatively cold area such as a players' bench at a football field, in which a self-contained heater is preferably located parallel to and adjacent a back wall of the setup, which back wall together with front and side walls and seat and backrest form an enclosure underneath the seat and also in back of the backrest. Heat from the heater goes into a preferably perforated pipe running the length of the enclosure underneath the seat. The front wall has openings from the outside into small individual enclosures, which openings are positioned to admit the lower legs and feet of people sitting on the seat, and are covered by interior doors when not in use; the upper part of the backrest has openings from which hot air is directed downwardly on the shoulders and surrounding areas of the bodies of people sitting on the seat; within the back part of the enclosure are areas for warming such things as footballs and towels.

4 Claims, 9 Drawing Figures

FIG. 3
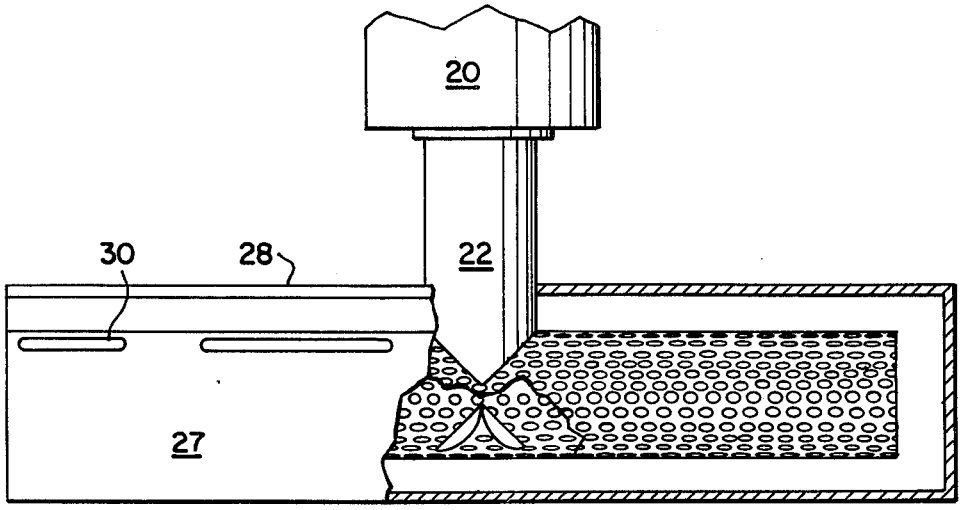
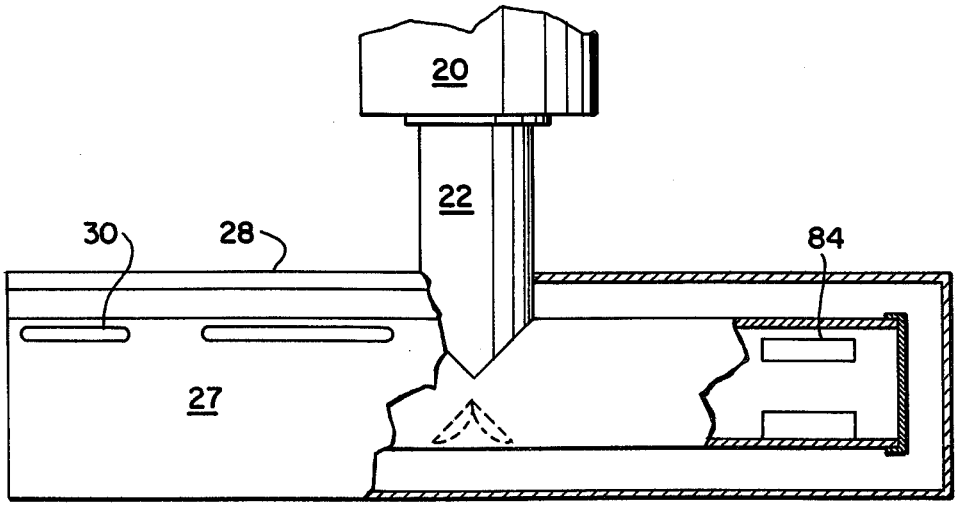
FIG. 4

SEATING SETUP

BRIEF SUMMARY OF THE INVENTION

The present invention involves a seating setup.

It is an improvement over the setup described in my U.S. Pat. No. 3,948,246, issued Apr. 6, 1976, herein incorporated by reference, which you will note includes certain of the same features.

A purpose of the invention is to provide a seating setup for use in a relatively cold setting, such as for example a bench for players in a football game, which will keep them warm, yet at the same time be quite practical and economical.

A further purpose of the invention is to provide such a setup which has especially suitable and practical arrangements to insure warming of the lower legs and feet, and the area around the shoulders, of the people on the seat.

A further purpose is to provide such a setup in which the experience by the occupants of unnecessary noise will be minimized.

A further purpose is to provide such a setup which provides good distribution of warming air by a simple, practical arrangement.

A further purpose is to provide such a setup for outdoor sports such as football in which articles associated with the sport are warmed in a very convenient handy setup.

BRIEF DESCRIPTION OF THE DRAWINGS

Specific illustrative embodiments of the invention are shown in the drawings, which are as follows:

FIG. 3 is a plan view, partly broken away, of still another embodiment of the invention.

FIG. 4 is a plan view, partly broken away, of another embodiment of the invention.

DETAILED DESCRIPTION, INCLUDING SPECIFIC EMBODIMENTS

Figure 1:
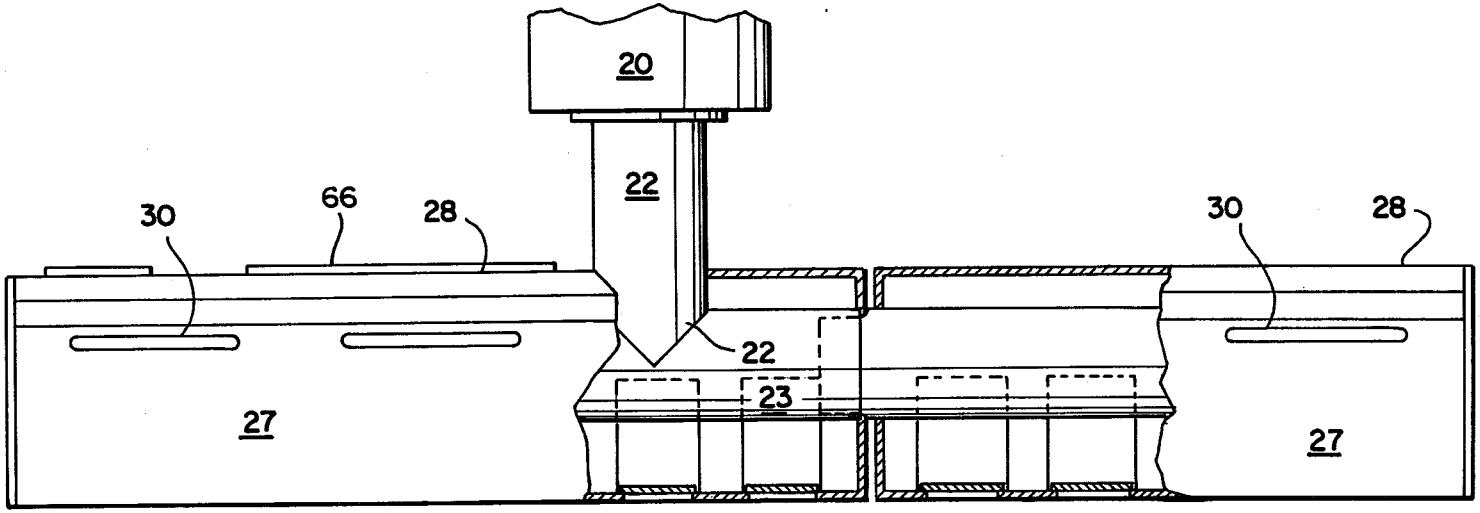
FIG. 1 is a plan view, partly broken away, of an embodiment of the invention.

Describing in illustration and not in limitation and referring to the drawings:

The seating setup of my invention includes a seat structure, including seating surface 27, and a heater 20. Between the two is piping, which may in one illustrative embodiment (FIG. 1) be straight piping 22 which goes directly into the seat structure and there is joined to extended T-head 23 which runs more or less the entire length of two particular units of the seat structure, and in another illustrative embodiment (FIG. 2) may be curved to ultimately form a right angle bend and in this case joined to a similar T-head between units of seat structure.

The seat structure forming a major part of the invention has seat surface 27, impervious except for rear air openings 30, and back rest 28, impervious except for top air openings 78, seat and backrest being for example made of plywood. Up from the ground or other base surface, come supporting front wall 26, side walls such as 25, and back wall 24, (see for example FIG. 5) which along with the seat and backrest form an enclosure under the seat extending up also behind the backrest.

Starting at a slightly lower level than top front openings 33 in the front wall, are elongated openings in that front wall going all the way down to near the ground or other base, positioned to be able to admit the lower legs and feet of someone seated on that seat. On the inside of these openings are doors 50 hinged at the top at 52 to enable the doors to swing back when these lower legs and feet are brought back against the doors, the hinges being spring biased toward closure when this is not prevented by the openings being in use to admit the lower legs and feet to the interior and have them kept warm there.

In the case of each such opening, there extends diagonally down and back in a position behind the door when thus swung back, a sloping wall 56 of inner enclosure 54, which also has side walls 60. The three walls of the inner enclosure end at their bottom on a line substantially short of the bottom of the main enclosure, leaving a gap below their skirt bottom which is preferably on the order of one and one half inches, for air to come from the rest of the main enclosure into these inner enclosures. To add to this effect there are also a certain number of perforations (not shown) in the sloping wall 56 of the inner enclosure.

Figure 5:
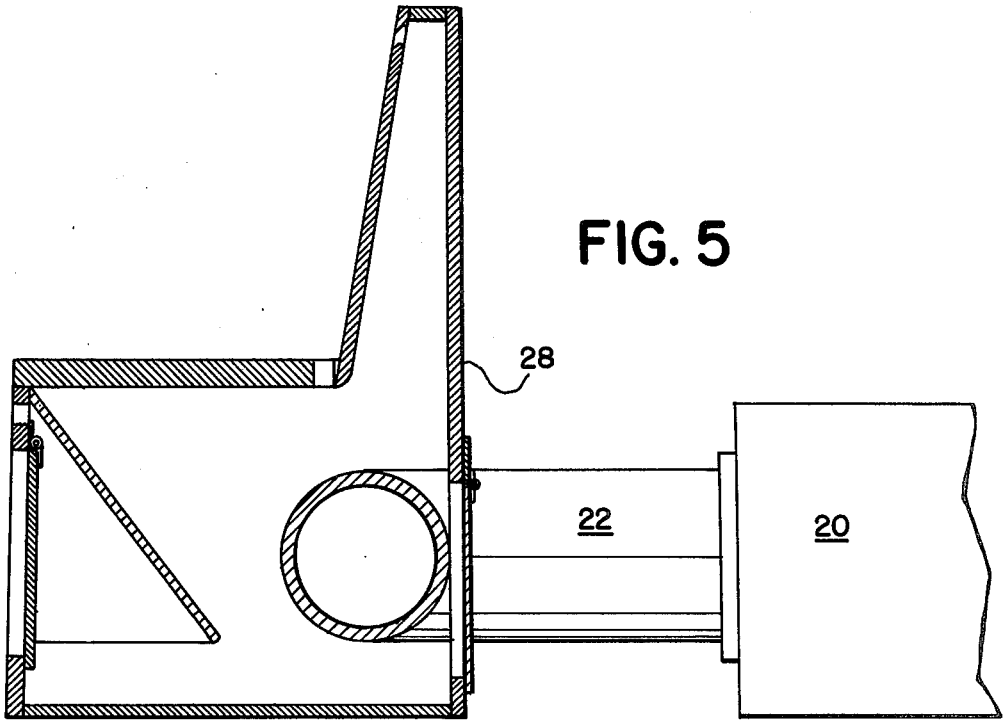
FIG. 5 is a sectional view of another somewhat variant embodiment.
Figure 6:
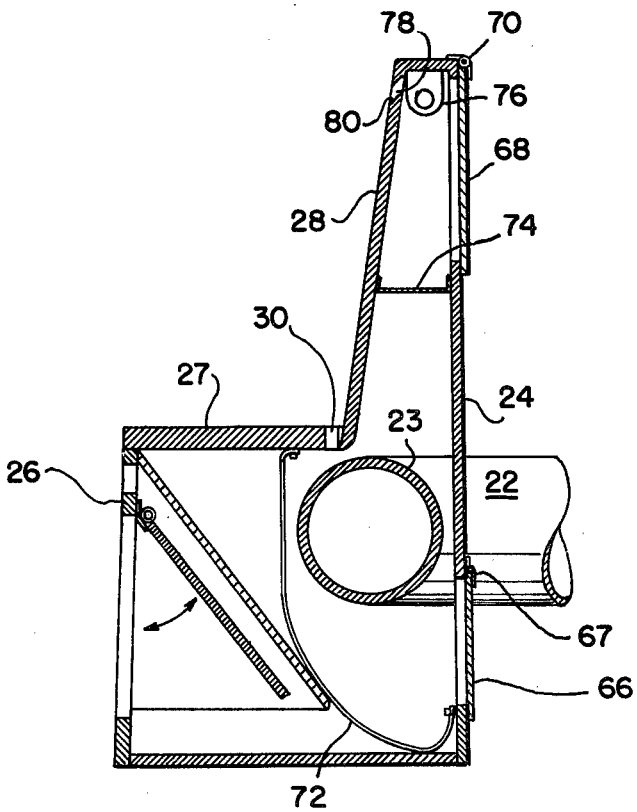
FIG. 6 is a sectional view of still another somewhat variant embodiment.
Figure 7:
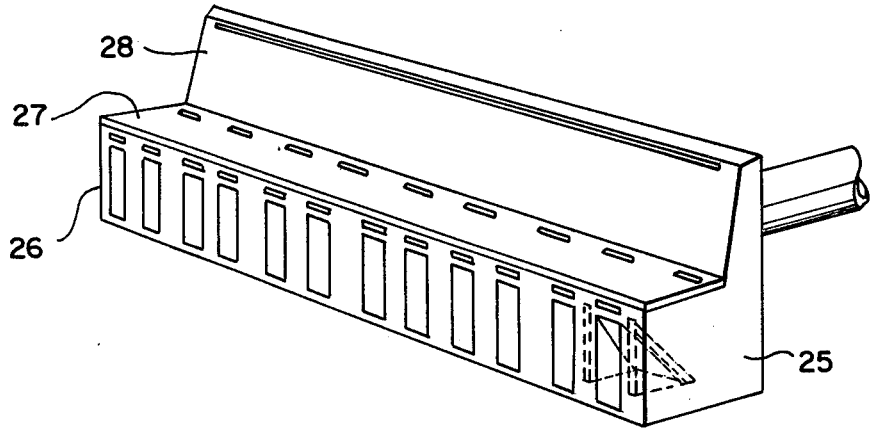
FIG. 7 is a perspective view of the form of FIG. 1, taking one seating unit of it as a separate thing.
Figure 8:
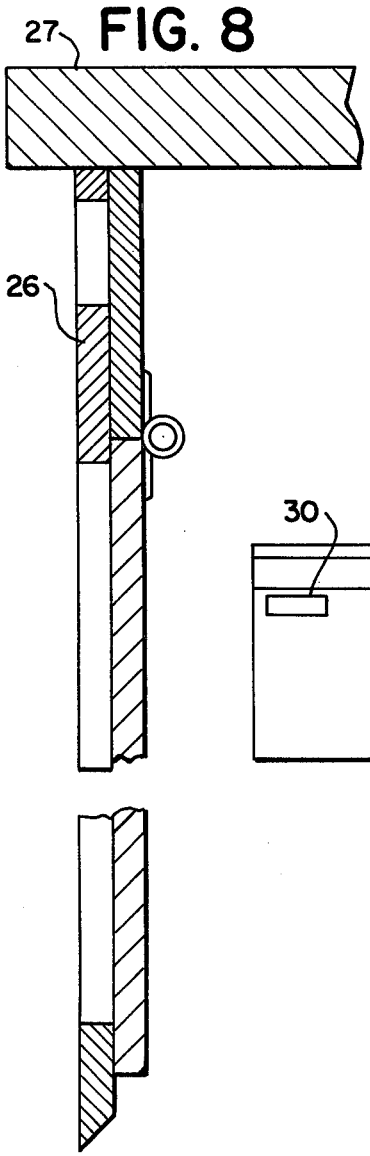
FIG. 8 is a fragmentary sectional view of one particular form which the front of the setup may take.

Preferably, as shown for example in FIGS. 5 and 6, front wall 26 slopes slightly forward as it goes from top to bottom, the slope being preferably sufficient to bring the bottom end of the wall on the order of three inches further forward than its top end. This has the advantage of permitting the occupant of the seat in question to bring this lower leg and foot into the warmth of the inner enclosure without bringing it as far back as he would otherwise be required to.

As already indicated, near the top of backrest 28 is opening 78 (FIG. 6) which permits warm air from the part of the main enclosure behind the backrest to go out at this point. The front part 80 (FIG. 6) of this opening slopes downward toward the front at an angle, so that as the warm air comes out, it tends to go downward onto the shoulders and upper arms and the rest of the area surrounding the shoulders of the people who are sitting there.

Warm air will likewise come out from the main enclosure at openings 30 and 31 toward the rear of seat surface 27, and 33 toward the top of front wall 26, with warming effect on the occupants in the area adjacent to the openings, openings 33 for example having a tendency especially to warm the knees of the people sitting there.

Figure 2:
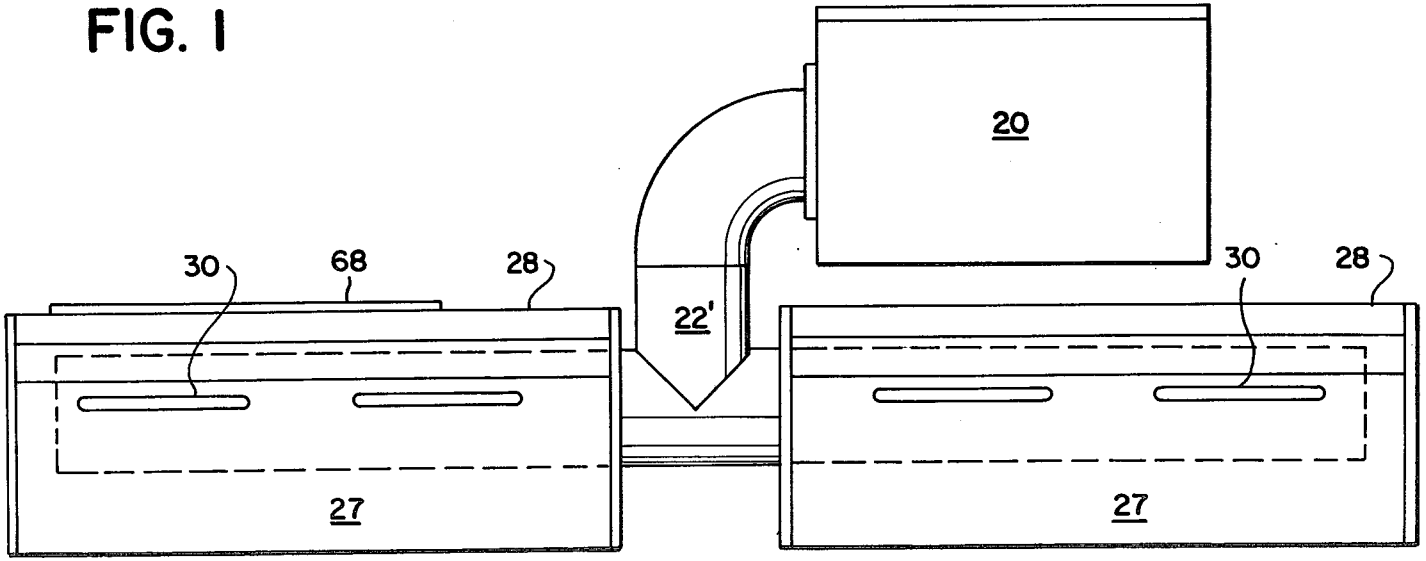
FIG. 2 is a plan view of another embodiment of the invention, preferred in certain respects.

In the form of FIG. 2, the heater 20, which is preferably a self-contained combustion heater with a blower to direct heated air out onto the piping, is located on the ground or other base surface, outside of but adjacent to the back wall 24 (see FIG. 6) of a seating unit, with the axis and direction of blower action of the heater unit being parallel to that back wall. This form has the special advantage, as compared to that of FIG. 1, that the interrelation of the various aspects of the setup is such as to tend to minimize the extent of the noise of the heater as far as the occupants of the seating unit and their hearing of that noise are concerned, even where in the interests of economy, practicality and convenience there is used a heater and blower unit that would be in itself comparatively noisy to someone who should go behind the seat and approach it.

T-head pipe 23 preferably has openings at various points throughout its length to permit hot air to escape into the main enclosure over more or less the entire length of the seating unit, thus giving better distribution of the hot air in that unit and its enclosure than would be secured if the T-head pipe were open only at its end. These openings can take various forms, such as the elongated openings 84 shown in FIG. 4, or the generally perforated pipe shown in FIG. 3, with perforations preferably on the order of three eights of an inch in diameter.

A double-fin setup, with two more or less cylindrically rounded dish-shaped members at the point where the air must make a right angle turn at the juncture between T-leg 22 and T-head 33, are shown in FIG. 3 and in phantom in FIG. 4, and have value in facilitating the passage of the warm air into T-head pipe 23. As will be seen from the drawings, the fins are set more of less at right angles back-to-back, to divert into opposite directions the different halves of the stream of warm air coming in.

Where the seating setup is used for the players' bench at a baseball game, it is considered likely to be advantageous to have the heater right to the side at the end of the bench setup, with the pipe proceeding from that in a straight line into one or two bench units from there, without the use of any T-head arrangement.

Figure 9:
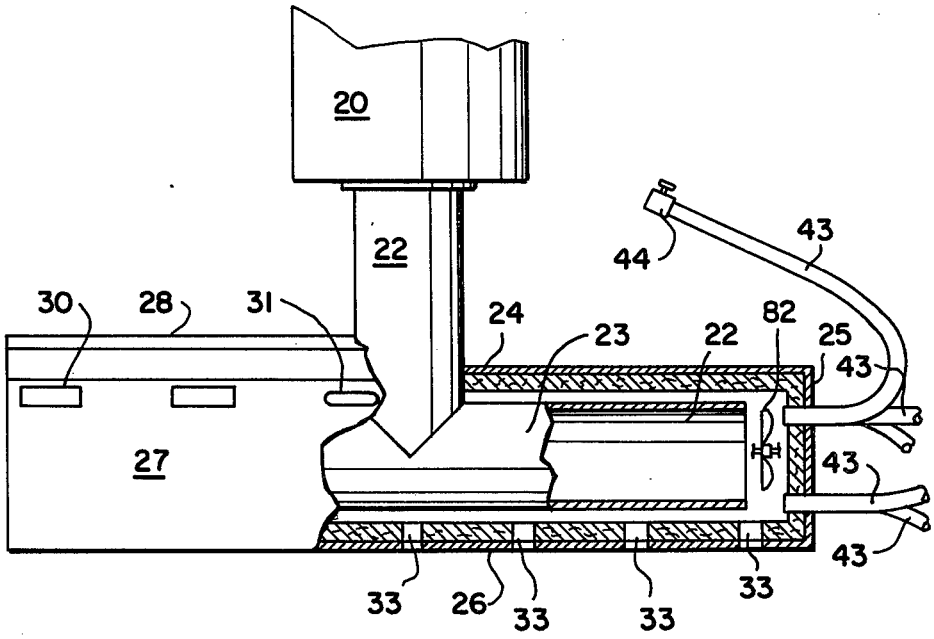
FIG. 9 is a special view of a particular setup different from all the rest, but intended to illustrate a particular aspect all could have if desired.

The seating unit can have at its end flexible conduits 43 (FIG. 9) extending from the interior of the main enclosure, having valves 44 at their ends, which will be available for special warming purposes, as where a player wants to warm the area under his parka, or to warm his hands before he goes into a game. Where this feature is present, it is advantageous to have some kind of special device to cause the warm air to pass in some quantity through the conduit, such as for example fan 82 (FIG. 9) located more or less just inside the openings into the conduits, to drive the air into them, which fan can for example be driven by a conventional motor (not shown), the fan being for example a squirrel cage fan.

A convenient length of a particular individual seating structure in twelve feet, with the heater supplying hot air to two of them.

The interior compartment 54 may for example be of galvanized iron or molded fiberglass.

A thermostatic setup (not shown) can be used to control the heat in the main enclosure, for example by turning the heater off when it gets too hot there and turning it on when it gets colder than desired. If desired, regulation of the warmth of the air coming in from the heater into the bench can be secured by admitting also air from outside to mix with it before it comes in and thus moderate the overall heat of the air in question.

The particular setup involved lends itself to other advantageous features. In the lower back, as shown especially in FIG. 6, wire mesh 72 forms a lower inner compartment into which gives an opening in the lower part of back wall 24 by door 66, urged to closure by spring hinge 67. When the seating setup is used as a bench for football players, this inner compartment is very convenient for warming footballs, so that when they are put into use they can be thrown and handled well. A football which is warm and dry is not only less likely to slip out of the hands of the players but is more pliable and therefore can more readily be grasped by the hand preparatory to throwing a pass for example.

So likewise, FIG. 6 shows another compartment having perforated shelf 74 as its bottom, and accessible by means of an opening in the upper part of back wall 24 covered by door 68, urged to closure by spring hinge 70. In the top of this compartment is towel rack 76, and in the case where the particular seating setup is used for players in a particular sport, this compartment is very handy to keep things like towels, gloves, shoes and medical devices of one kind or another, for example, warm and dry for possible use.

These compartments do not prevent the warm air from circulating.

The present invention is a meritorious setup which when properly used possesses the capability of keeping players, for example, and the things they are using, in a suitably warm condition, including in this respect especially such important parts of their bodies as their shoulders, upper arms and lower legs and feet. This is done despite possible adverse weather conditions in which temperatures may go very low, especially in playing sports like football, which is popular throughout the north, and in which the normal playing season lasts into late autumn and post season games, especially among the professionals, are likely to be played in the winter. The special features of the present invention are expected to be especially valuable when outdoor temperatures go below 25° F., which is not at all uncommon in the playing of football and other outdoor sports with similar seasons such as soccer. The present invention secures there benefits by a setup which is at the same time both effective and also quite practical and economical.

In view of my invention and disclosure, variations and modifications to meet individual whim or particular need will doubtless become evident to others skilled in the art to obtain all or part of the benefits of my invention without copying the apparatus shown, and I, therefore, claim all such insofar as they fall within the reasonable spirit and scope of my claims.

While a self-contained combustion heater, utilizing as special possibility petroleum or liquid propane or natural gas is preferred for the heater 20, any suitable heater, such as an electric, steam, hot water, or wood or coal fueled heater should be used.

Having thus described my invention what I claim as new and desire to secure by Letters Patent is:

1. A seat for a plurality of persons seated side by side having a top seating portion on which they can sit and front, side and back walls extending down to form with that seating portion an enclosure underneath that seating portion, a self-contained heating unit adapted to heat the air for the space within the enclosure, pairs of openings in the front wall elongated in the up-and-down direction, the individual openings being located beside each other in position and size to receive at least the greater part of the lower legs and feet of occupants of the seat when they are inserted at least partly in the backward direction and each having a door hinged at the top and adapted to swing back into the interior of the enclosure for this purpose, and individual enclosures behind the door extending down to substantially above the floor of the enclosure which is underneath the seat top and adapted to otherwise at least mainly surround the lower legs and feet from the rear and sides when they are within the enclosure underneath the seat top, while permitting the above-mentioned doors to swing back to permit the lower legs and feet to be inserted at least partly in the backward direction and go at least mainly into the enclosure underneath the seat top.

2. A seat of claim 1, in which the front walls in question slope in a frontward direction as they extend downwardly from the seating surface.

3. An outdoor sports seating setup for a plurality of people seated side by side in a cold environment, which setup is located in some suitable base surface such as the ground, comprising a sheet-type seating surface, a sheet-type backrest extending upward from the rear of the seating surface to above the shoulders of the people seated upon it and adapted to contact and help support the entire length of their backs, a front wall, a back wall spaced behind the backrest and two side walls all extending upwardly from the base surface to the seating surface and backrest to form an overall enclosure with them which includes both space underneath the seating surface and space between the backrest and the back wall, a self-contained heating unit including a blower which unit is located on the base surface outside of the enclosure and adjacent to but behind the back wall in a position in which the blower is directed parallel to that wall, a pipe to take the hot air from the blower into the space underneath the seating surface which pipe proceeds from the unit to a T-pipe which includes a multiplicity of perforations along the length of the cross portion of the T within the space underneath the seating surface, the front wall sloping at least somewhat rearwardly as it proceeds upward from the base surface and having openings elongated in the up-and-down direction which are each adapted to admit at least the rear of a foot and lower leg of an occupant of seating setup, each such opening having an inner door spring-biased to close it and adapted to swing into the interior of the enclosure to permit insertion of at least the rear of such foot and lower leg when an effectively downwardly force is applied to the door, and there being behind such opening an inner enclosure having a sloping back wall and side walls all ending at the bottom at a place spaced from the bottom of the enclosure, an opening in the backrest adjacent the top of the backrest and directed toward the front from the interior of the enclosure and having its front portion directed at least somewhat downwardly, and compartments in the rear of the enclosure walled off from the rest of the enclosures by foraminated structure permitting warm air to circulate through and adapted to hold articles associated with the sport.

4. A seating setup for a team in outdoor sports comprising a seat for a plurality of persons, a backrest adapted to contact and help support the entire length of the back of the persons seated, a front wall extending down from the seat to the base surface in a downward forward slope, and side and back walls which with the front wall seat, backrest and base surface complete an enclosure below the seat and extending up behind the backrest, a self-contained heater outside of that enclosure which heats air, piping for such heated air from that heater into the interior of the enclosure where such piping for heated air from the heater is present the greater part of the length of the seat, such piping in that interior having multiple perforations for permitting heated air to escape into the enclosure throughout an extended length of that enclosure, openings in the backrest adapted to direct heated air from the enclosure forwardly and downwardly over the shoulders and upper arms of the persons eated on the seat, and vertically elongated openings in the front wall covered by cover members adapted to reach inwardly on pressure from the backs of the legs and feet of persons seated on the seat, to open up the openings to receive into the enclosure at least the backs of those legs and feet.

* * * * *